US005094226A

United States Patent [19]

Medcalf et al.

[11] Patent Number: 5,094,226

[45] Date of Patent: Mar. 10, 1992

[54] CONTINUOUS PASSIVE MOTION DEVICE FOR THE FIRST METATARSAL PHALANGEAL JOINT

[75] Inventors: Mark T. Medcalf, Westlake Village; Charles A. Kelman, Woodland Hills; Jeno B. Gutai, Thousand Oaks, all of Calif.

[73] Assignees: Mark T. Medcalf, 3449 Whiteriver/91361 Woodland Hills; Charles A. Kelman, 23011 Gainford/91364 Westlake Village, both of Calif.

[21] Appl. No.: 607,990

[22] Filed: Oct. 31, 1990

[51] Int. Cl.[5] ..... B01H 1/02

[52] U.S. Cl. ..... 128/25 B; 128/25 R; 128/52

[58] Field of Search ..... 128/25 R, 25 B, 26, 128/51, 52, 56; 272/96

[56] References Cited

U.S. PATENT DOCUMENTS

| | | | |
|---|---|---|---|
| 2,217,445 | 10/1940 | Kauffman . | |
| 2,255,066 | 9/1941 | Lamb | 128/25 B |
| 2,311,274 | 2/1943 | Whitney . | |
| 2,397,428 | 3/1946 | Moshier | 128/25 B |
| 2,513,408 | 7/1950 | Fayne . | |
| 2,674,242 | 4/1954 | Bierman | 128/25 B |
| 2,696,206 | 12/1954 | Bierman . | |
| 3,421,500 | 1/1969 | Jacobson . | |
| 3,789,836 | 2/1974 | Girten | 128/25 B |
| 3,917,261 | 11/1975 | Small et al. | 128/25 B X |
| 4,003,374 | 1/1977 | Mizrachy . | |
| 4,199,137 | 4/1980 | Giguere . | |
| 4,282,865 | 8/1981 | Pogue . | |
| 4,474,176 | 10/1984 | Farris et al. . | |
| 4,492,222 | 1/1985 | Hajianpour . | |
| 4,537,083 | 8/1985 | Saringer . | |
| 4,600,188 | 7/1986 | Bargerter et al. | 272/96 |
| 4,637,379 | 1/1987 | Saringer . | |
| 4,671,257 | 6/1987 | Kaiser et al. . | |
| 4,671,258 | 6/1987 | Barthlome . | |
| 4,705,028 | 11/1987 | Melby | 128/25 B X |
| 4,715,361 | 12/1987 | Mauldin et al. . | |
| 4,834,073 | 5/1989 | Bledsoe et al. . | |
| 4,842,265 | 6/1989 | Kirk . | |
| 4,862,875 | 9/1989 | Heaton | 128/25 R X |
| 4,869,499 | 9/1989 | Schiraldo . | |
| 4,940,046 | 6/1990 | Jacoby . | |
| 4,967,736 | 11/1990 | Spitzer | 128/25 B |
| 4,967,736 | 11/1990 | Spitzer . | |

OTHER PUBLICATIONS

Danniger Medical, Mobilimb Upper Limb GPM Units.
Danniger Medical, Mobilimb Hand CPM Units.
Danniger Medical, DanniFlex 400i CPM System.
Danniger Medical, Danniflex 400SL CPM System.
Stryker, Stryker Leg Exerciser continuous passive motion.
Invacare, Total CPM.
Toronto Medical, Mobilimb L2, Lower Limb CPM.

*Primary Examiner*—Richard J. Apley
*Assistant Examiner*—Linda C. M. Dvorak
*Attorney, Agent, or Firm*—Kelly, Bauersfeld & Lowry

[57] ABSTRACT

A device for engaging the big toe of a user to provide continuous passive motion to the first metatarsal phalangeal joint includes an electric motor situated within a box-like housing, a piston having a first end coupled to a drive shaft turned by the motor, a toe engaging attachment coupled to a second end of the piston, a rotatable foot support plate to accommodate the shift from right to left foot and vice versa, and a heel cradle for selective foot size adjustment. The rotational motion of the drive shaft is converted into reciprocating and substantially linear motion of the toe engaging attachment causing movement of the big toe by pushing on the plantar aspect upward, thus allowing for dorsi flexion of the joint. The toe engaging attachment is interchangeable depending on the degree of dorsi flexion desired. When the toe is to be put through a limited degree of dorsi flexion, a toe engaging attachment with a spring loaded plunger is used.

19 Claims, 4 Drawing Sheets

CONTINUOUS PASSIVE MOTION DEVICE FOR THE FIRST METATARSAL PHALANGEAL JOINT

FIELD OF THE INVENTION

The present invention relates generally to orthopedic joint rehabilitation devices. More specifically, this invention relates to continuous passive motion device for rehabilitating the first metatarsal phalangeal joint following surgical treatment including bunionectomies.

BACKGROUND OF THE INVENTION

The foot provides support for the rest of the body when the body is in the erect position. The big toe assists in this support. The first metatarsal phalangeal joint of the big toe is the point of maximum propulsion of the foot and must be capable of 60°-75° dorsi flexion for normal ambulation.

Unfortunately, bunions (Hallux Valgus), are often formed on the first metatarsal phalangeal joint and may affect ambulation. A bunion is a condition which is defined as inflammation and pain associated with osseous hypertrophy of the first metatarsal head forming a medial eminence which may be associated with lateral deviation of the first metatarsal phalangeal joint. Although generally hereditary, bunions can be exacerbated by poor-fitting footwear.

Bunions can be excruciatingly painful. Bunion sufferers often therefore avoid certain activities and try to avoid wearing shoes as much as possible, both because of the pain and because it is extremely difficult to find footwear which will accommodate the bunion. Bunion sufferers may also compensate by changing the way they walk in order to alleviate the pain and discomfort. Such changes are unnatural and cause their movements to be inefficient causing strain on the body parts too heavily relied upon. When a sufferer tires of living with constant pain, he or she may seek medical advice for definitive treatment of his or her bunions.

The treatment of bunions has historically ranged from symptomatic relief to surgical procedures involving removal of the bunion and realignment of the first metatarsal phalangeal joint. In most cases, surgery is critical to long-term relief of pain and improvement of ambulation. Bunionectomies are a common osseous procedure. In addition to bunions, other conditions of the first metatarsal phalangeal joint may require surgery. Such conditions might include Hallux Rigidus/-Limitus; Osteoarthritis and Traumatic Arthritis; Hallux Abducto Valgus; Traumatic Crush Injury; and conditions precedent to open reduction of fractures of the first metatarsal phalangeal joint.

Following surgery on the metatarsal phalangeal joint, the joint must recover and be rehabilitated. Immobilization or rest of recovering joints has long been an unchallenged tenet of orthopedics. The effects of immobilization have been widely reported. Muscular atrophy and joint stiffness are, by far, the most obvious side effects of immobilization. Bone atrophy also results from immobilization and it appears logical to assume that other musculoskeletal structure including tendons, ligaments and collagen matrix will also atrophy when they are protected from the stimulus of physiological loading.

Continuous passive motion (CPM) contributes more to joint rehabilitation following surgery than immobilization. It helps assure a good surgical outcome by improving the joint's rate of healing and decreasing the possibility of limited range of motion after healing is completed. Range of motion is a critical parameter of joint healing and patient recovery. CPM contributes greatly to improved ambulation. The clinical advantages of continuous passive motion, as compared with immobilization, are providing earlier motion, achieving functional range of motion earlier, achieving a greater ultimate range of motion, decreasing postoperative pain and swelling, prevention of intra-articular adhesions and extra-articular contractures, and decreasing the incidence of deep venous thrombosis by improving venous dynamics. In spite of widespread recognition of the advantages of continuous passive motion over immobilization, no prior devices provide continuous passive motion to the first metatarsal phalangeal joint, isolation of which is critical following surgery thereon.

Accordingly, there has been a need for a novel continuous passive motion device which is light weight for portability, and operates smoothly and relatively silently. Such a device is needed which can run unattended, allows for altering the range of motion appropriate for each patient, is easy to use with a patient-controlled on/off switch, and can be used in the hospital or at home. Additionally, a continuous passive motion device for the first metatarsal joint is needed which may be used sitting or in a supine position, is easily cleaned and stored, able to take the affected toe through its full range of motion, easily adjusts from left to right foot and vice versa, and accommodates different foot sizes. The present invention fulfills these needs and provides other related advantages.

SUMMARY OF THE INVENTION

The present invention resides in a novel continuous passive motion device for the first metatarsal phalangeal joint, which is useful following surgery in order to improve the joint's rate of healing and decrease the possibility of limited range of dorsi flexion after healing is completed. The continuous passive motion device comprises, generally, drive means within a housing for moving a toe engaging attachment outside the housing through its range of motion, a piston which couples the drive means to the toe engaging attachment, and foot support means for supporting the foot with the affected toe (whether it be the right or left foot) while the device is being used and for permitting selective foot length adjustment. The piston is attached to the drive means in a manner converting the rotational motion of a drive shaft into reciprocating and substantially linear motion of the toe engaging attachment. The toe engaging attachment pushes upwardly on the big toe's plantar aspect, allowing for dorsi flexion of the first metatarsal phalangeal joint, and then retracts downwardly to its original position.

In a preferred form of the invention, the housing includes a base portion including a top plate and a handle. The drive means is positioned within the housing and secured to the underside of the top plate. The drive means includes an electric motor and reducing gear means interposed between the electric motor and the drive shaft. The drive means further includes an eccentric crank-like sleeve which is fixed to an end of the drive shaft and turns therewith. A pair of cords extend through the housing to provide power to the electric motor and to permit a user of the continuous passive motion device to turn the motor off and on.

The piston includes a piston head which abuts the toe engaging attachment, and a piston rod which is rotatably attached at a first end to the eccentric crank-like sleeve and pivotally attached at a second end to the piston head. More particularly, the piston rod is rotatably attached to the eccentric crank-like sleeve at an offset position relative to the longitudinal axis of the drive shaft. A bolt connects the first end of the piston rod to the crank-like sleeve, and a sleeve bearing permits the bolt to rotate within the first end of the piston rod as the drive shaft and the crank-like sleeve turn.

The second end of the piston rod fits into the bottom of the piston head in a yoke arrangement such that the piston rod is in a pivotable relationship with respect to the piston head. The top of the piston head defines a cup-shaped cylindrical receptacle, and moves through an aperture in the top plate of the housing. A piston head guide is connected to the housing in proximity to the top plate aperture to insure that the piston head reciprocates substantially linearly along a predetermined axis.

The toe engaging attachment includes a cylindrical base which sits within the cup-shaped cylindrical receptacle of the piston head in a friction fit. A toe platform supporting the plantar aspect of the big toe is pivotally attached to the cylindrical base. The toe platform is shaped preferably like the head of a spoon, and may optionally contain means to strap the toe onto the toe platform. An attachment flange extending rearwardly from the toe platform pivotally attaches the toe platform to the cylindrical base.

In a first illustrated embodiment, the cylindrical bas is substantially solid and the attachment flange is pivotally attached directly to the base. The length of the cylindrical base may be varied to accommodate the range of motion desired. The longer the cylindrical base, the greater the degree of dorsi flexion.

A second illustrated embodiment is preferred when the toe is to be put through a lesser degree of dorsi flexion force. In this embodiment, the cylindrical base of the toe engaging attachment is hollow and includes a spring-loaded plunger to which the attachment flange is pivotally attached. The hollow cylindrical base may also vary in length. In addition, the springs may vary to accommodate different loads or forces.

The foot support means includes a foot support plate rotatably fastened to the top plate of the housing, and a heel cradle. Means are provided for locking the foot support plate in a desired position (i.e. right or left foot) relative to the housing top plate and for locking the heel cradle in the foot support plate to permit selective foot length adjustment.

Means are provided for securing the foot to the upper surface of the foot support plate, including first and second sets of mated straps. The first set of mated straps is preferably fastened over the forefoot while the second set of mated straps is fastened over the instep.

When the motor is actuated, the piston head moves in a reciprocating and linear fashion up through the top plate aperture, forcing like motion of the toe engaging attachment. This causes movement of the toe by pushing on the plantar aspect upward, thus causing dorsi flexion of the joint. The motor elevates the toe to a limit predetermined by the particular toe engaging attachment selected. The toe platform returns to its resting position and the procedure is repeated until the length of treatment time prescribed has been attained.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
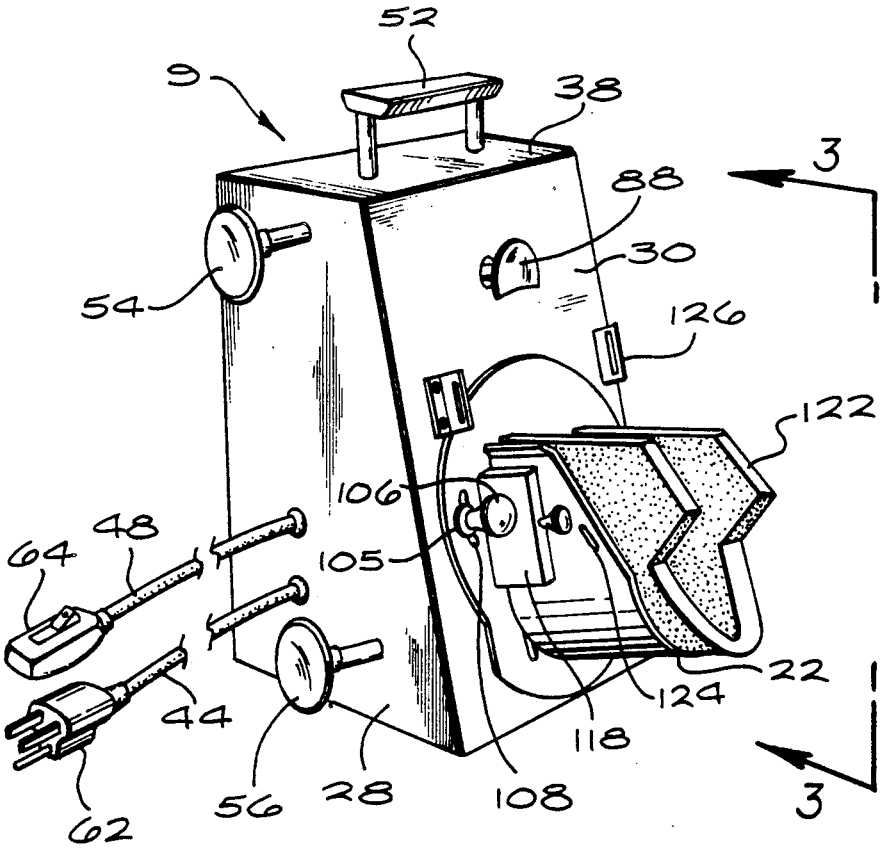
FIG. 1 is a perspective view of a continuous passive motion device for the first metatarsal phalangeal joint embodying the invention, having foot straps omitted therefrom for clarity.
Figure 2:
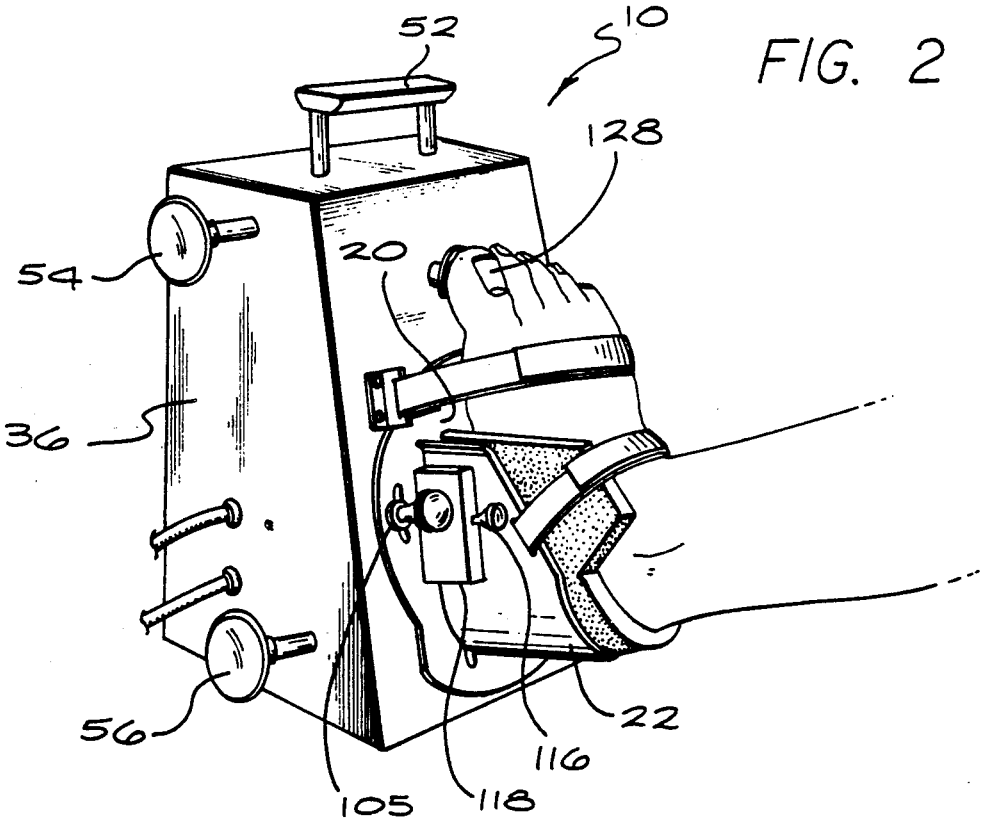
FIG. 2 is a perspective view of the continuous passive motion device shown in FIG. 1, illustrating the manner in which a user would position a foot thereon such that the big toe's plantar aspect is positioned directly over a linearly reciprocable toe engaging attachment.
Figure 3:
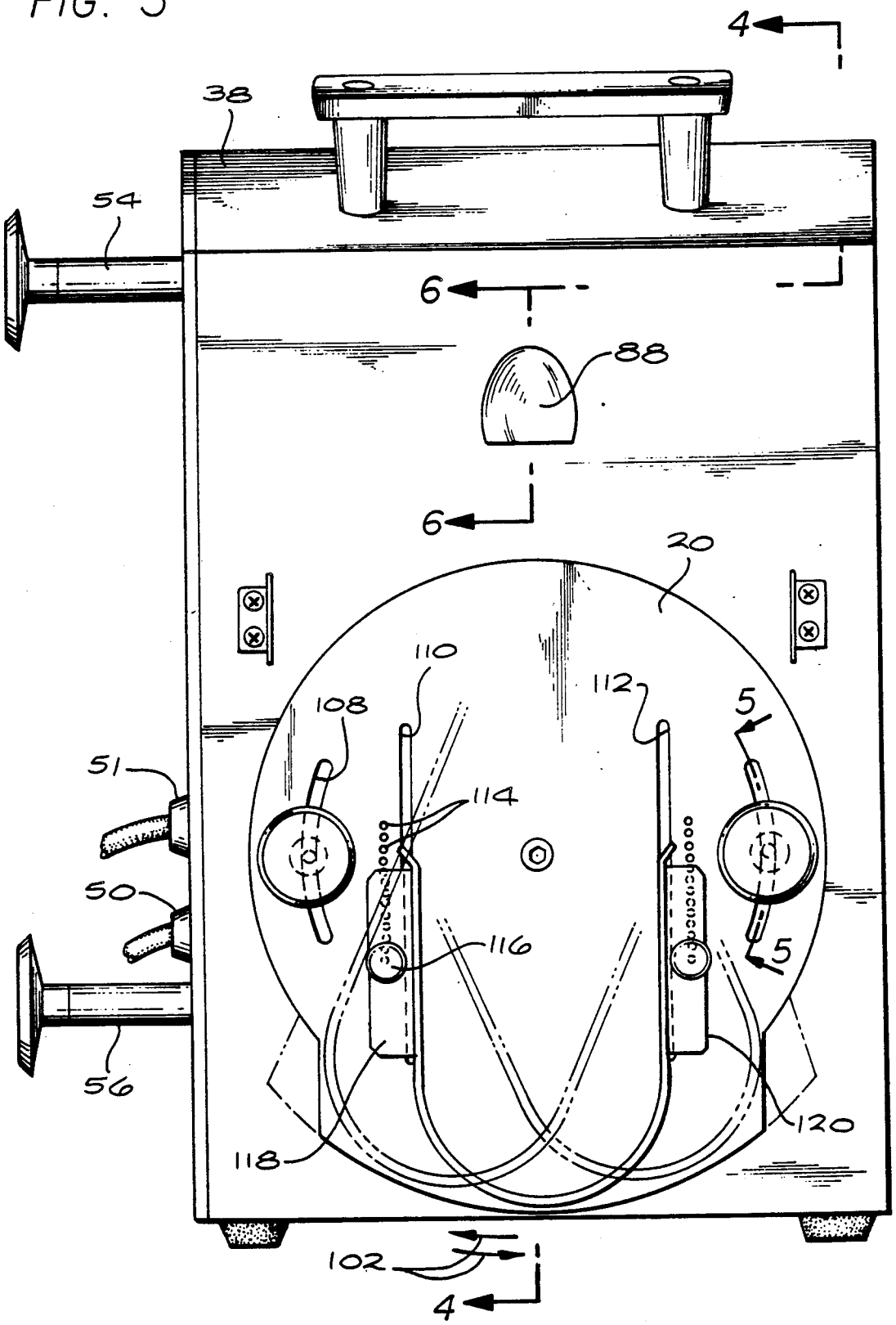
FIG. 3 is an enlarged top plan view of the continuous passive motion device illustrated in FIGS. 1 and 2, taken generally in the direction of the arrows 3—3 of FIG. 1.

As shown in the drawings for purposes of illustration, the present invention is concerned with a novel continuous passive motion (CPM) device for the first metatarsal phalangeal joint, generally designated by the reference number 9. The CPM device 9 comprises, generally, a box-like housing 10 which encloses an electric motor 12 and a reducing gear box 14 for moving a toe engaging attachment 16 outside the housing through its range of motion, a piston 18 which couples the motor and gear box to the toe engaging attachment 16, a foot support plate 20 for supporting the right or left foot when the toe is on the toe engaging attachment, a heel cradle 22 which is adjustable to the particular length foot, and fastening straps 24 and 26 to hold the foot onto the foot support plate.

In accordance with the present invention, and as illustrated with respect to an embodiment shown in FIGS. 1–7, the box-like housing 10 includes a base portion 28 including a top plate 30. The housing is constructed of surgical metal such as stainless steel to give the housing strength but also making it cleanable. In addition to the top plate 30, the base portion 28 has a detachable floor 32 connected to left and right side walls 34 and 36, respectively, and front and back end walls 38 and 40, respectively. The detachable floor is used as a service panel to access the motor and gear box.

The base portion 28 is preferably declined for purposes which will become clear hereinafter such that the left and right side walls 34 and 36 of the base portion are substantially identically sized, while the front end wall 38 is narrower than the back end wall 40. Apertures 42 and 46 are provided in one of the side walls 34 of the housing to permit a flexible power cord 44 and a control cord 48 to extend therethrough. Grommets 50 and 51 line each of the wall apertures through which the power cord 44 and the control cord 48 extend, to reduce wear on the cords. A handle 52 is connected to the front end wall 38 to facilitate carrying of the device by an individual. Non-skid bumpers 53 are provided on the back end wall 40 so that the device can be set firmly on a planar surface. A pair of knobs 54 and 56 are provided at the right side wall 36 of the housing 10 for wrapping the power and control cords 44 and 48.

Figures 4, 5:
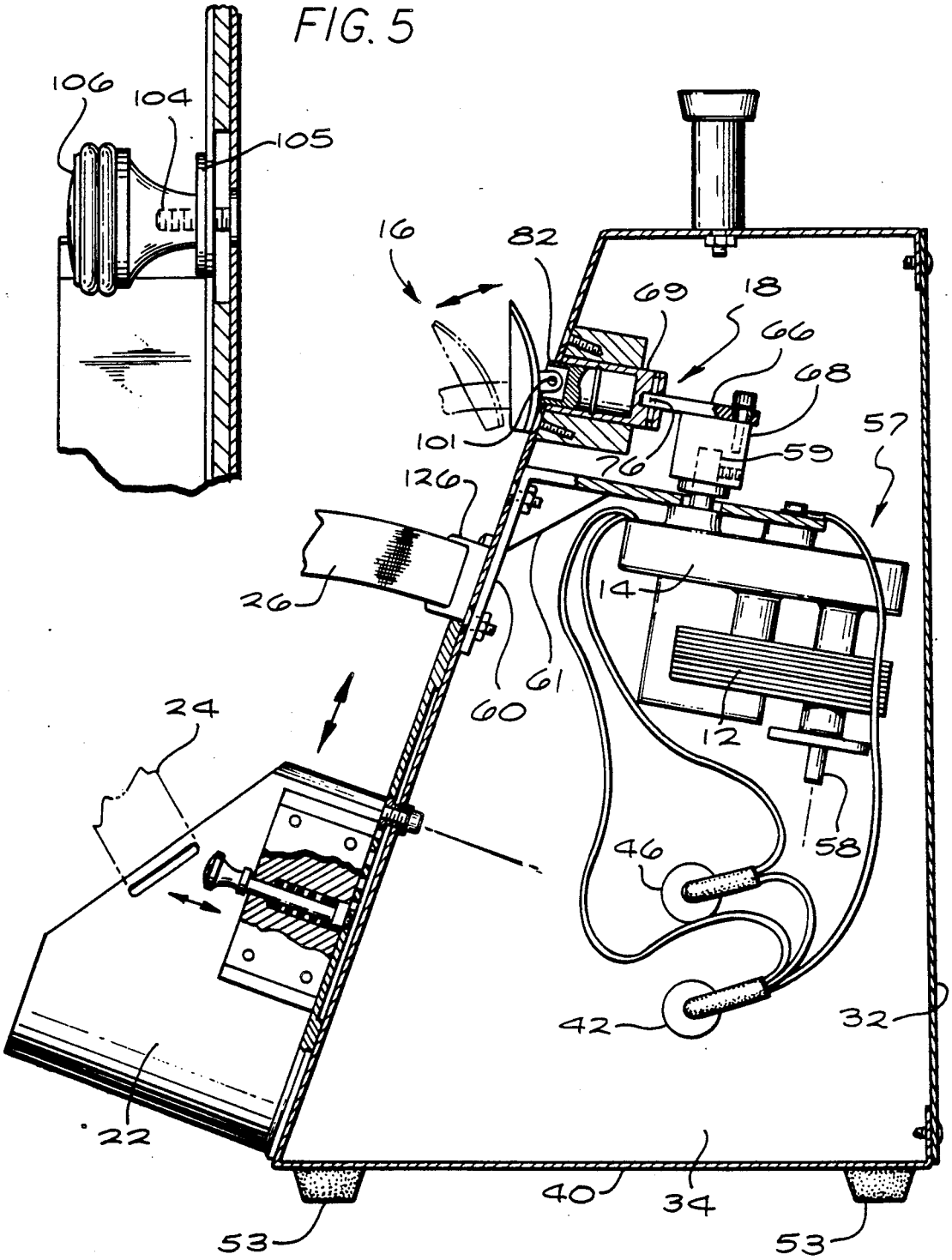
FIG. 4 is a sectional view taken generally along the line 4—4 of FIG. 3, illustrating the internal components of the continuous passive motion device, and particularly the arrangement of an electric motor positioned therein for driving, through a reduction gear box, a piston which couples the output of the motor to the toe engaging attachment.
FIG. 5 is an enlarged fragmented partially sectional view taken generally along the line 5—5 of FIG. 3.
Figure 6:
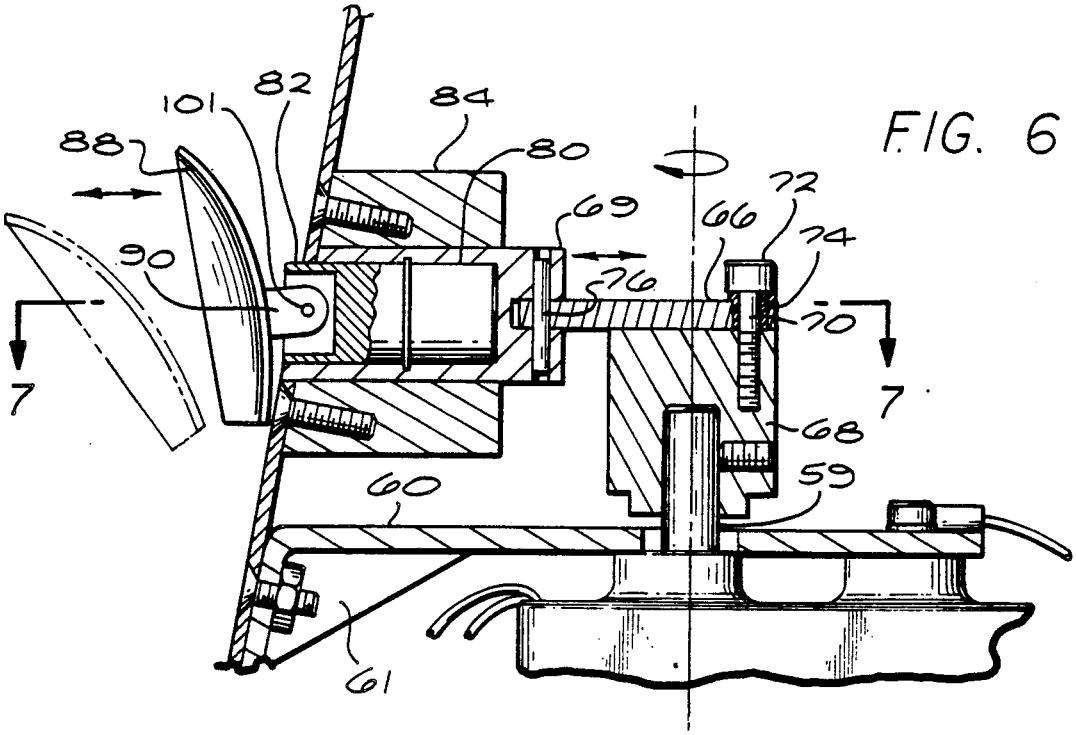
FIG. 6 is an enlarged fragmented and partially sectional view of the components coupling an output drive shaft driven by the electric motor, with the toe engaging attachment.

As shown best in FIG. 4, a gear/motor unit 57 includes a motor drive shaft 58 which provides input to the electric motor 12 and the gear box 14. The gear box 14 contains an arrangement of gears (not shown). The electric motor 12 turns a drive shaft 59 through the reducing gear box 14 interposed between the electric motor and the drive shaft. This arrangement converts the high rate of rotation of the motor 12 into a slower rate of rotation of the drive shaft 59 at a reduction ratio, preferably of about 500:1, though this ratio should not be limiting. For maximum degree of dorsi flexion, the torque of the drive shaft can be about 24 lbs/inch. This may vary depending on the motor, the toe engaging attachment, etc. Constant unit speed is maintained. The unit is secured to the underside of the top plate 30 by means of an L-shaped bracket 60 which has an aperture through which the drive shaft 59 extends. The L-shaped bracket may also include a brace 61.

The power cord 44 extends from a power source (not shown) through the first aperture 42 in the right side wall 36 of the housing 10 to the electric motor 12. Electrical power is conveniently obtained from a suitable 115 V power source via the power cord 44 and a plug 62. The control cord 48 extends from a hand actuator switch 64 to the motor 12 through the second aperture 46 in the right side wall 36 of the housing 10. The hand actuator on/off switch 64 provides positive control over actuation of the electric motor 12. Therefore, a user of the device is able to stop any motion that causes discomfort. It should be apparent to one of ordinary skill in the art that although the on/off switch 64 is illustrated as independent of the housing, it would be a simple matter to mount one directly onto the housing 10. The controls are built-in such that by simply plugging in the device, the travel speed is electronically maintained.

The piston 18 includes a piston rod 66 which is rotatably attached at a first end to an eccentric crank-like sleeve 68 which is fixed to an end of the drive shaft 59. The sleeve 68 turns with the drive shaft 59. The piston rod 66 is pivotally attached at a second end to a piston head 69. As shown best in FIG. 6, the piston rod 66 is rotatably attached to the eccentric crank-like sleeve 68 by aligning an aperture 70 through the first end of the piston rod 66 and holding the piston rod and eccentric crank-like sleeve in a rotatable relationship by inserting a bolt 72 through the aperture 70. The piston rod 66 is attached at an offset position relative to the longitudinal axis of the drive shaft 59. A sleeve bearing 74 is placed between the bolt 72 and the adjacent portion of the piston rod 66.

The second end of the piston rod 66 fits into the bottom of the piston head 69 in a yoke arrangement. The bottom of the piston head 69 has a 2-sided channel 76 with centrally aligned apertures on both sides perpendicular to the channel. A pin 78 holds the piston rod in the channel and permits pivotal movement between the piston rod and the piston head, i.e, it, allows for the conversion of rotational movement of the drive shaft 59 to translational motion of the piston 18. The top of the piston head 69 defines a cup-shaped cylindrical receptacle 80 which moves in reciprocating and substantially linear fashion through a top plate aperture 82.

A piston head guide 84, connected to and positioned immediately below the top plate aperture 82, insures reciprocating and substantially linear motion of the piston head 69 along its longitudinal axis. The piston head guide 84 defines an axis along which the piston head 69 reciprocates.

The toe engaging attachment 16 includes a cylindrical base 86 which sits within the cup-shaped cylindrical receptacle 80 of the piston head 69 in a friction fit. A toe platform 88 contoured to the shape of a big toe, (for example, shaped like the head of a spoon) is pivotally attached to the cylindrical base 86. To this end, an attachment flange 90 extends rearwardly from the center of the toe platform 88. The toe platform may contain straps (not shown) to secure the toe onto the toe platform 88. The length of the cylindrical base 86 varies and is selected to alter the degree of flexion appropriate for each patient. The longer the cylindrical base, the greater the degree of flexion.

Figure 8:
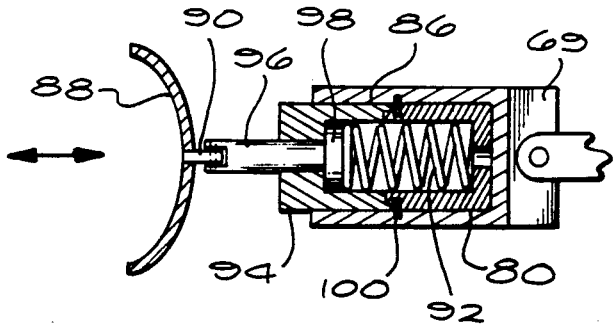
FIG. 8 is a sectional view similar to that illustrated in FIG. 7, illustrating an alternative embodiment of the toe engaging attachment, which includes a spring-loaded plunger for limiting flexion of the first metatarsal phalangeal joint.
Figure 7:
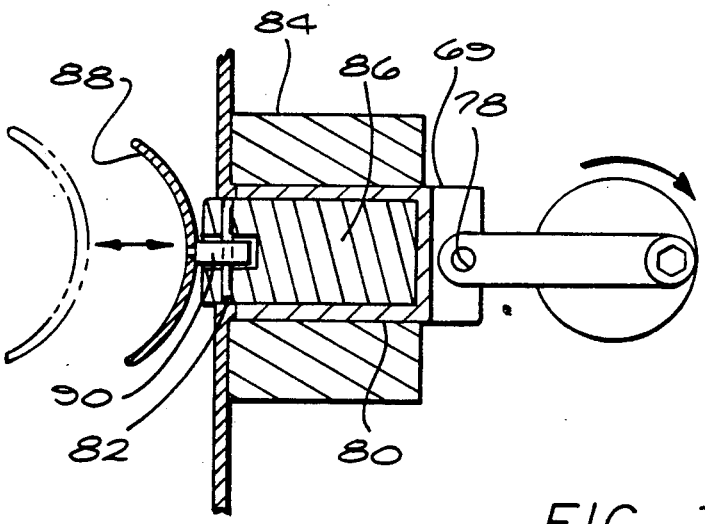
FIG. 7 is a sectional view taken generally along the line 7—7 of FIG. 6.

In a first embodiment, illustrated in FIG. 7, the cylindrical base 86 is substantially solid. This is for use when the toe is to be put through its maximum flexion, usually at the end of the rehabilitative process. In a second illustrated embodiment shown in FIG. 8, the cylindrical base is hollow. The bottom of the hollow cylindrical base holds a spring 92. A plunger collar 94 holds the spring in the base. A plunger 96 extends through the plunger collar and has a plunger flange 98 which abuts the top of the spring 92, providing a surface for the spring to push against. A C-shaped retaining ring 100 retains the plunger collar 94 on the bottom part of the base. The attachment flange 90 is pivotally attached to the top of the plunger 96.

The top of the cylindrical base 86 has a two-sided channel with centrally aligned apertures on both sides perpendicular to the channel. A pin 101 holds the rearwardly extending attachment flange in the channel and permits pivotal movement of the toe platform. The toe engaging attachment 16 is interchangeable, allowing for different ranges of motion. Therefore, the practitioner can easily control the rehabilitative process by prescribing a particular toe engaging attachment.

The foot support plate 20 is rotatably fastened to the top plate 30 of the housing 10. When the foot support plate 20 is rotated by the hand of the user in the direction shown by the arrows 102 at the bottom of FIG. 3, the foot support plate 20 rotates about 23° on each side to accommodate the shift from right to left foot. The foot support plate 20 is rotatable so the right or left foot is placed at an angle to the toe platform 88 such that there is alignment with the joint. Bolts 104 on each side of the foot support plate 20 having a knob-like handle 106 are each positioned in circular slots 108. A washer 105 is also used for each bolt. The circular slots 108 move as a result of rotation of the foot support plate such that the knobbed bolt 104 will end up in a different position in the circular slot than before rotation. The bolts 104 are loosened when the foot support plate 20 is to be rotated and tightened when the desired position is reached.

The heel cradle 22 supports the back of the foot when the toe is on the toe platform 88. The inner contour of the heel cradle is in a facing relation with the toe platform. Right and left longitudinal slots 110 and 112, respectively, in the direction of the toe platform 88 are centrally positioned on the foot support plate 20. The slots define guide tracks in which the heel cradle 22 is guided for selective foot length adjustment. The correct adjustment permits the toe to be on the toe platform 88 and the back of the heel placed comfortably against the inner contour of the heel cradle 22. The heel cradle 22 can be adjustably locked in the desired position in the right and left longitudinal slots. The foot support plate 20 includes a plurality of right and left apertures 114 spaced outside and parallel to the right and left longitudinal slots 110 and 112. Spring-loaded locking pins 116 are supported at the upper end of each of right and left blocks 118 and 120, respectively, and extend therethrough for engagement with one of the plurality of apertures 114 provided in the foot support plate 20. The blocks 118 and 120 are attached to the right and left sides of the heel cradle 22, respectively. Thus, the length from toe to heel can be selectively adjusted to fit the foot size of different users of the device by locking the heel cradle in place by means of the locking pins 116. The heel cradle 22 can also accommodate foot dressings and/or may be equipped with soft goods 122 which add to patient comfort. The soft goods are washable and replaceable. In the preferred embodiment the soft goods are compressed foam which conform to the inner contour of the heel cradle 22 and cushion the user's heel against the heel cradle.

Fastening straps 24 and 26 are utilized for adjustably fastening the foot to the device 9. Each of the front sides of the straps **24*a* and 26*a* from one side of the device are cushioned and have a Velcro (hook and loop tape) backing, and are mated with straps 24*b* and 26*b* from the other side which have a complementary Velcro front surface. These mated straps can be pressed together or pulled apart for easy fastening and unfastening. The placement of the straps 24 and 26 is a matter of practitioner judgment though straps over the instep and forefoot are preferred. When fastened over the forefoot, the straps 24*a* and 24*b* are attached to the heel cradle by any known method. For example, in the preferred embodiment, there are elongated slots 124 near the upper edge of both the right and left sides of the heel cradle 22 above the right and left blocks 118 and 120 through which the set of mated straps for the forefoot may be fastened. For the set of straps 26*a* and 26*b* over the instep, there are brackets 126 with elongated slots fastened to the top side of the top plate 30**, the straps being fastened through the slots in the brackets.

The device 9 is ready for use once the appropriate toe engaging attachment 16 is selected, the device set on a suitable surface such that the top plate 30 faces forward and the front end wall faces upward and the device plugged in. The user would be supine with the foot elevated above the heart level to reduce swelling. A sitting position is most commonly used at a later stage in healing and gives the active ambulatory patient greater freedom for using the CPM device 9 at home. When sitting, the top plate faces upward when the device is in use. The base portion 28 of the housing 10 is itself declined about 20° from perpendicular to allow for comfortable positioning of the foot and ankle. Pillows under the leg also aid in getting comfortable positioning of the foot and ankle when the patient is supine. In order to ready the device for the particular user, the heel cradle is unlocked and put in the position which is the farthest from the toe platform 88. The user then places the heel in the heel cradle 22 and rotates the foot support plate 20 to a position which aligns the big toe with the toe platform. If necessary, the heel cradle is then moved in the guide tracks toward the toe platform such that the toe is on the toe platform and the back of the heel of that same foot is supported by the heel cradle. The heel cradle and the foot support plate are then locked into position. The straps 24 and 26 are fastened and the device is turned on by the hand actuator 64.

The toe engaging attachment 16 is elevated to a preset limit as determined by which toe engaging attachment is selected, through a determined stroke with a slow rhythmic motion. Movement of the big toe 128 is accomplished by pushing on the plantar aspect upward, thus allowing an excellent mechanical advantage for dorsi flexion of the first metatarsal phalangeal joint. The toe engaging attachment 16 then relaxes to its resting position and the procedure is repeated until the length of treatment time specified by the practitioner has been attained. In many cases, continuous passive motion is applied at the completion of the surgical procedure in the recovery room and is continued for a minimum of about one week. The necessary length of time depends upon the individual, the severity of the condition, and the practitioner.

From the foregoing, it is to be appreciated that the novel continuous passive motion device 9 is powered by ordinary household electrical current, is lightweight and can be carried about freely, is easy to clean and use, and can be used on either the right or left foot. The fact that the toe engaging attachment 16 is removable from the remainder of the device 9 permits easy cleaning of the attachments after use and allows for easy prescription of the proper range of motion.

Although two particular embodiments of the invention have been described in detail for purposes of illustration, various modifications of each may be made without departing from the spirit and scope of the invention. Accordingly, the invention is not to be limited, except as by the appended claims.

We claim:

1. A continuous passive motion device for providing dorsi flexion to the first metatarsal phalangeal joint, the device comprising:

means for engaging the big toe of a user, the toe engaging means including a toe platform pivotally attached by pivot means to a base;

means for driving the toe engaging means through its range of motion, the drive means including a rotatable drive shaft; and a piston which couples the drive means to the toe platform through said base and said pivot means in a manner converting rotational motion of the drive shaft into reciprocating and substantially linear motion of the toe engaging means.

2. The continuous passive motion device of claim 1, wherein the toe engaging means base is substantially solid, the top of the base having a two-sided channel with centrally aligned apertures through which a pin is inserted in a direction perpendicular to the channel to pivotally attach to the base an attachment flange extending rearwardly from the toe platform.

3. The continuous passive motion device of claim 1, wherein the drive means includes an electric motor and gear means interposed between the electric motor and the drive shaft for reducing a high rate of rotation of the electrical motor into a slower rate of rotation of the drive shaft.

4. The continuous passive motion device of claim 1, wherein the piston includes a piston head which abuts the toe engaging means, and a piston rod, the first end of the piston rod being rotatably attached to an eccentric crank-like sleeve which is fixed to an end of the drive shaft and turns therewith and the second end of which is pivotally attached to the piston head, the first end of the piston rod rotatably attached at an offset position relative to the longitudinal axis of the drive shaft.

5. The continuous passive motion device of claim 1, including means for supporting the foot when the toe is on the toe platform, including a rotatable foot support plate to accommodate the right or left foot, and a heel cradle for supporting the back of the heel when the toe is on the toe platform.

6. The continuous passive motion device of claim 5, including means for adjusting the position of the heel cradle, said adjustment means including right and left guide tracks in the foot support plate for moving the heel cradle to a desired position.

7. The continuous passive motion device of claim 6, including means for locking the heel cradle in the guide tracks at a desired position, said locking means including spring-loaded locking pins which engage one of a plurality of apertures provided parallel to the guide tracks in the foot support plate.

8. A motorized device for providing dorsi flexion to the big toe of a user, the device comprising:

drive means positioned within a housing which includes a top plate, said drive means including a motor and gear means interposed between the electric motor and a drive shaft for reducing a high rate of rotation of the motor into a slower rate of rotation of the drive shaft, an eccentric crank-like sleeve fixed to an end of the drive shaft and turning therewith;

a piston including a piston head and a piston rod coupled to the drive means, the first end of the piston rod is rotatably attached to the eccentric crank-like sleeve and the second end of which is pivotally attached to the piston head;

toe engaging means for engaging the big toe of a user, said toe engaging means including a toe platform pivotally attached by pivot means to a base which abuts the piston head, the toe platform moved through its range of motion through said base and said pivot means by the drive means which are coupled to the piston rod in a manner converting rotational motion of the drive shaft into reciprocating and substantially linear motion of the toe platform; and foot support means for accommodating either the right or left foot and for permitting selective foot length adjustment, including a rotatable foot support plate and a heel cradle for supporting the back of the heel when the toe is on the toe platform.

9. The continuous passive motion device of claim 8, wherein the base is substantially solid and is pivotally attached to the toe platform by an attachment flange extending rearwardly from the toe platform.

10. The continuous passive motion device of claim 8, wherein the piston rod is rotatably attached to the eccentric crank-like sleeve at an offset position relative to the longitudinal axis of the drive shaft, the attachment between the piston rod and the eccentric crank-like sleeve effected through use of a bolt and a sleeve bearing.

11. A continuous passive motion device, comprising:

a toe engaging attachment for engaging the big toe of a user, the toe engaging attachment including a toe platform pivotally attached to a cylindrical base by an attachment flange;

a box-like housing including a base portion including a top plate, handle means for carrying the housing, and at least one aperture through the top plate;

means positioned within the housing and secured to the underside of the top plate for driving the toe engaging attachment through its range of motion, the drive means including an electric motor which turns a drive shaft, and gear means interposed between the electric motor and the drive shaft for reducing a high rate of rotation of the electric motor into a slower rate of rotation of the drive shaft;

power supply means extending from a power source, through the housing, to the electric motor;

control means including an on/off switch extending from outside the housing, to the electric motor;

an eccentric crank-like sleeve fixed to an end of the drive shaft and turning therewith;

a piston having a piston head which abuts the toe engaging attachment and a piston rod which is rotatably attached at a first end to the eccentric crank-like sleeve by a bolt and sleeve bearing at an offset position relative to the longitudinal axis of the drive shaft and pivotally attached at a second end to the piston head, the piston rod coupled to the drive means in a manner converting rotational motion of the drive shaft into reciprocating and substantially linear motion of the toe engaging attachment, the top of the piston head defining a cup-shaped cylindrical receptacle which moves through the aperture in the top plate of the housing and receives the cylindrical base of the toe engaging attachment;

a piston head guide connected to and immediately below the top plate aperture, which positions the piston head to ensure reciprocating and substantially linear motion of the piston head along its longitudinal axis;

a rotatable foot support plate fastened to the top plate of the housing, rotatable for accommodating the left or right foot; and a heel cradle for supporting the back of the heel when the toe is on the toe platform, the position of which can be adjusted by guiding the heel cradle in right and left longitudinal slots to the desired position and locking the heel cradle in the desired position by means of spring-loaded locking pins aligned with one of a plurality of right and left apertures spaced outside and parallel to the right and left longitudinal slots.

12. The continuous passive motion device of claim 11, wherein the cylindrical base includes a spring-loaded plunger pivotally attached to the attachment flange extending rearwardly from the toe platform.

13. A continuous passive motion device for providing dorsi flexion to the first metatarsal phalangeal joint, the device comprising:

means for engaging the big toe of a user, the toe engaging means including a toe platform pivotally attached to a base, the base including a spring-loaded plunger pivotally attached to an attachment flange extending rearwardly from the toe platform;

means for driving the toe engaging means through its range of motion, the drive means including a rotatable drive shaft; and a piston which couples the drive means to the toe engaging means in a manner converting rotational motion of the drive shaft into reciprocating and substantially linear motion of the toe engaging means.

14. A continuous passive motion device for providing dorsi flexion to the first metatarsal phalangeal joint, the device comprising:

means for engaging the big toe of a user, the toe engaging means including a toe platform pivotally attached to a base;

means for driving the toe engaging means through its range of motion, the drive means including a rotatable drive shaft; and a piston which couples the drive means to the toe engaging means in a manner converting rotational motion of the drive shaft into reciprocating and substantially linear motion of the toe engaging means, the piston including a piston head which abuts the toe engaging means, and a piston rod, the first end of the piston rod being rotatably attached to an eccentric crank-like sleeve which is fixed to an end of the drive shaft and turns therewith and the second end of which is pivotally attached to the piston head, the first end of the piston rod rotatably attached at an offset position relative to the longitudinal axis of the drive shaft, the piston head including a cup-shaped cylindrical receptacle which moves in reciprocating and substantially linear fashion and receives the base of the toe engaging means, said reciprocating and substantially linear motion insured by a piston head guide which defines an axis along which the piston head reciprocates.

15. A motorized device for providing dorsi flexion to the big toe of a user, the device comprising:

drive means positioned within a housing which includes a top plate, said drive means including a motor and gear means interposed between the electric motor and a drive shaft for reducing a high rate of rotation of the motor into a slower rate of rotation of the drive shaft, an eccentric crank-like sleeve fixed to an end of the drive shaft and turning therewith;

a piston including a piston head and a piston rod coupled to the drive means, the first end of the piston rod is rotatably attached to the eccentric crank-like sleeve and the second end of which is pivotally attached to the piston head;

toe engaging means for engaging the big toe of a user, said toe engaging means moved through its range of motion by the drive means which are coupled to the piston rod in a manner converting rotational motion of the drive shaft into reciprocating and substantially linear motion of the toe engaging means, said toe engaging means including a toe platform pivotally attached to a base which abuts the piston head, the base including a spring-loaded plunger pivotally attached to an attachment flange extending rearwardly from the toe platform; and foot support means for accommodating either the right or left foot and for permitting selective foot length adjustment, including a rotatable foot support plate and a heel cradle for supporting the back of the heel when the toe is on the toe platform.

16. A motorized device for providing dorsi flexion to the big toe of a user, the device comprising:

drive means positioned within a housing which includes a top plate, said drive means including a motor and gear means interposed between the electric motor and a drive shaft for reducing a high rate of rotation of the motor into a slower rate of rotation of the drive shaft, an eccentric crank-like sleeve fixed to an end of the drive shaft and turning therewith;

a piston including a piston head and a piston rod coupled to the drive means, the first end of the piston rod is rotatably attached to the eccentric crank-like sleeve and the second end of which is pivotally attached to the piston head;

toe engaging means for engaging the big toe of a user, said toe engaging means moved through its range of motion by the drive means which are coupled to the piston rod in a manner converting rotational motion of the drive shaft into reciprocating and substantially linear motion of the toe engaging means, said toe engaging means including a toe platform pivotally attached to a base which abuts the piston head, the piston head including a cup-shaped cylindrical receptacle which moves through an aperture in the top place of the housing in reciprocating and substantially linear fashion and receives the base of the toe engaging means; and foot support means for accommodating either the right or left foot and for permitting selective foot length adjustment, including a rotatable foot support plate and a heel cradle for supporting the back of the heel when the toe is on the toe platform.

17. The continuous passive motion device of claim 16, wherein a piston head guide is connected to and immediately below the aperture in the top plate to insure reciprocating and substantially linear motion of the piston head.

18. A motorized device for providing dorsi flexion to the big toe of a user, the device comprising:

drive means positioned within a housing which includes a top plate, said drive means including a motor and gear means interposed between the electric motor and a drive shaft for reducing a high rate of rotation of the motor into a slower rate of rotation of the drive shaft, an eccentric crank-like sleeve fixed to an end of the drive shaft and turning therewith;

a piston including a piston head and a piston rod coupled to the drive means, the first end of the piston rod is rotatably attached to the eccentric crank-like sleeve and the second end of which is pivotally attached to the piston head;

toe engaging means for engaging the big toe of a user, said toe engaging means moved through its range of motion by the drive means which are coupled to the piston rod in a manner converting rotational motion of the drive shaft into reciprocating and substantially linear motion of the toe engaging means, said toe engaging means including a toe platform pivotally attached to a base which abuts the piston head; and foot support means for accommodating either the right or left foot and for permitting selective foot length adjustment, including a rotatable foot support plate and a heel cradle for supporting the back of the heel when the toe is on the toe platform wherein the position of the heel cradle is adjustable by moving the heel cradle in right and left guide tracks in the foot support plate to a desired position.

19. The continuous passive motion device of claim 18, wherein the heel cradle is lockable in the guide tracks in a desired position by means of spring-loaded locking pins which engage one of a plurality of apertures provided parallel to the guide tracks in the foot support plate.

* * * * *